US006540118B1

(12) United States Patent
Marciano

(10) Patent No.: US 6,540,118 B1
(45) Date of Patent: Apr. 1, 2003

(54) CLEANING SOLUTION DISPENSING DEVICE

(76) Inventor: Wayne J. Marciano, 27 Crows Nest La. #11-K, Danbury, CT (US) 06810

( * ) Notice: Subject to any disclaimer, the term of this patent is extended or adjusted under 35 U.S.C. 154(b) by 0 days.

(21) Appl. No.: 09/965,714

(22) Filed: Sep. 27, 2001

(51) Int. Cl.[7] ..... B67D 5/40

(52) U.S. Cl. ..... 222/385; 222/205; 239/550; 401/126; 401/127

(58) Field of Search ..... 222/378, 383.1, 222/385, 321.9, 321.6, 205; 401/126, 127, 130; 239/550, 566

(56) References Cited

U.S. PATENT DOCUMENTS

| | | | | | |
|---|---|---|---|---|---|
| 1,943,647 | A | | 1/1934 | Weller | |
| 2,752,069 | A | | 6/1956 | Welsh | |
| 2,790,984 | A | | 5/1957 | Gilpin | |
| 3,456,851 | A | * | 7/1969 | Mattes et al. | 222/205 |
| 3,739,955 | A | * | 6/1973 | Gores | 222/385 |
| 3,841,532 | A | * | 10/1974 | Gores | 222/205 |
| 4,171,171 | A | * | 10/1979 | Jones | 401/150 |
| D277,990 | S | | 3/1985 | Markarian | |
| 4,540,366 | A | * | 9/1985 | Belzile | 433/136 |
| 4,752,147 | A | | 6/1988 | Persi | |
| 5,431,879 | A | | 7/1995 | Heyl et al. | |
| 6,158,674 | A | * | 12/2000 | Humphreys | 239/333 |

* cited by examiner

*Primary Examiner*—Henry C. Yuen
*Assistant Examiner*—Patrick Buechner

(57) ABSTRACT

A cleaning solution dispensing device for dispensing a selected amount of cleaning solution upon a sponge. The cleaning solution dispensing device includes container support members for resting upon a surface; and also includes a container having top, side, and bottom walls and being attached to the support members and also having a reservoir disposed therein and further having a plurality of holes being disposed through the top wall and also having an opening being disposed through the bottom wall into the reservoir; and further includes a cap being removably disposed over the opening; and also includes a dispensing assembly being attached to the container for dispensing cleaning solution; and further includes sponge support members being disposed upon the container support members and the container for supporting a sponge.

7 Claims, 3 Drawing Sheets

CLEANING SOLUTION DISPENSING DEVICE

BACKGROUND OF THE INVENTION

1. Field of the Invention

The present invention relates to cleaning solution dispensers and more particularly pertains to a new cleaning solution dispensing device for dispensing a selected amount of cleaning solution upon a sponge.

2. Description of the Prior Art

The use of cleaning solution dispensers is known in the prior art. More specifically, cleaning solution dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,752,147; U.S. Pat. No. 1,943,647; U.S. Pat. No. 2,790,984; U.S. Pat. No. 5,431,879; U.S. Pat. No. 2,752,069; and U.S. Pat. No. Des. 277,990.

While these devices fulfill their respective, particular objectives and requirements, the aforementioned patents do not disclose a new cleaning solution dispensing device. The inventive device includes container support members for resting upon a surface; and also includes a container having top, side, and bottom walls and being attached to the support members and also having a reservoir disposed therein and further having a plurality of holes being disposed through the top wall and also having an opening being disposed through the bottom wall into the reservoir; and further includes a cap being removably disposed over the opening; and also includes a dispensing assembly being attached to the container for dispensing cleaning solution; and further includes sponge support members being disposed upon the container support members and the container for supporting a sponge.

In these respects, the cleaning solution dispensing device according to the present invention substantially departs from the conventional concepts and designs of the prior art, and in so doing provides an apparatus primarily developed for the purpose of dispensing a selected amount of cleaning solution upon a sponge.

SUMMARY OF THE INVENTION

In view of the foregoing disadvantages inherent in the known types of cleaning solution dispensers now present in the prior art, the present invention provides a new cleaning solution dispensing device construction wherein the same can be utilized for dispensing a selected amount of cleaning solution upon a sponge.

The general purpose of the present invention, which will be described subsequently in greater detail, is to provide a new cleaning solution dispensing device which has many of the advantages of the cleaning solution dispensers mentioned heretofore and many novel features that result in a new cleaning solution dispensing device which is not anticipated, rendered obvious, suggested, or even implied by any of the prior art cleaning solution dispensers, either alone or in any combination thereof.

To attain this, the present invention generally comprises container support members for resting upon a surface; and also includes a container having top, side, and bottom walls and being attached to the support members and also having a reservoir disposed therein and further having a plurality of holes being disposed through the top wall and also having an opening being disposed through the bottom wall into the reservoir; and further includes a cap being removably disposed over the opening; and also includes a dispensing assembly being attached to the container for dispensing cleaning solution; and further includes sponge support members being disposed upon the container support members and the container for supporting a sponge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cleaning solution dispensing device which has many of the advantages of the cleaning solution dispensers mentioned heretofore and many novel features that result in a new cleaning solution dispensing device which is not anticipated, rendered obvious, suggested, or even implied by any of the prior art cleaning solution dispensers, either alone or in any combination thereof.

It is another object of the present invention to provide a new cleaning solution dispensing device which may be easily and efficiently manufactured and marketed.

It is a further object of the present invention to provide a new cleaning solution dispensing device which is of a durable and reliable construction.

An even further object of the present invention is to provide a new cleaning solution dispensing device which is susceptible of a low cost of manufacture with regard to both materials and labor, and which accordingly is then susceptible of low prices of sale to the consuming public, thereby making such cleaning solution dispensing device economically available to the buying public.

Still yet another object of the present invention is to provide a new cleaning solution dispensing device which provides in the apparatuses and methods of the prior art some of the advantages thereof, while simultaneously overcoming some of the disadvantages normally associated therewith.

Still another object of the present invention is to provide a new cleaning solution dispensing device for dispensing a selected amount of cleaning solution upon a sponge.

Yet another object of the present invention is to provide a new cleaning solution dispensing device which includes container support members for resting upon a surface; and also includes a container having top, side, and bottom walls and being attached to the support members and also having a reservoir disposed therein and further having a plurality of holes being disposed through the top wall and also having an opening being disposed through the bottom wall into the reservoir; and further includes a cap being removably disposed over the opening; and also includes a dispensing assembly being attached to the container for dispensing cleaning solution; and further includes sponge support members being disposed upon the container support members and the container for supporting a sponge.

Still yet another object of the present invention is to provide a new cleaning solution dispensing device that is easy and convenient to use.

Even still another object of the present invention is to provide a new cleaning solution dispensing device that allows the container to rest safely and securely upon a surface while the user is dispensing cleaning solution therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
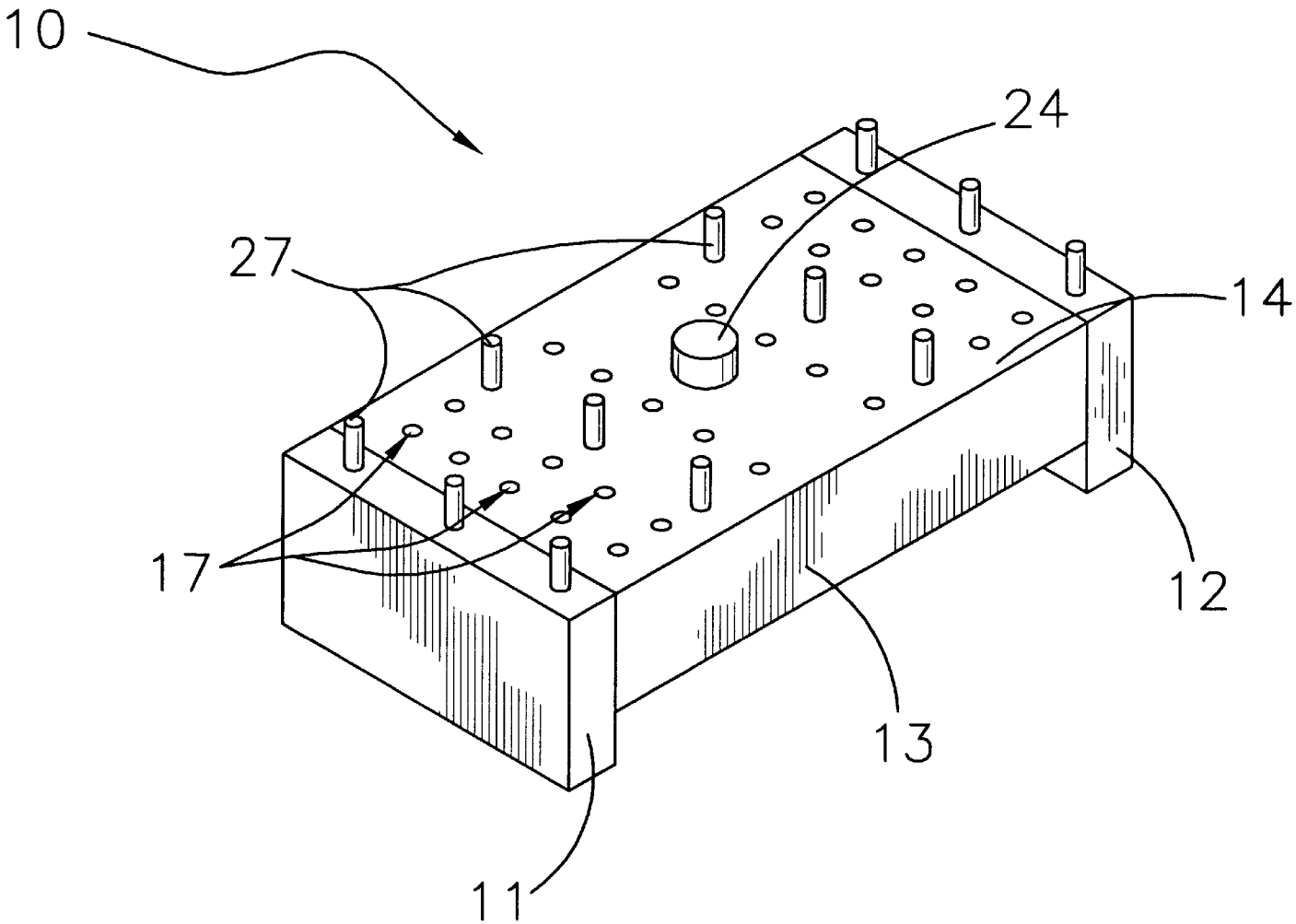
FIG. 1 is a perspective view of a new cleaning solution dispensing device according to the present invention.
Figure 2:
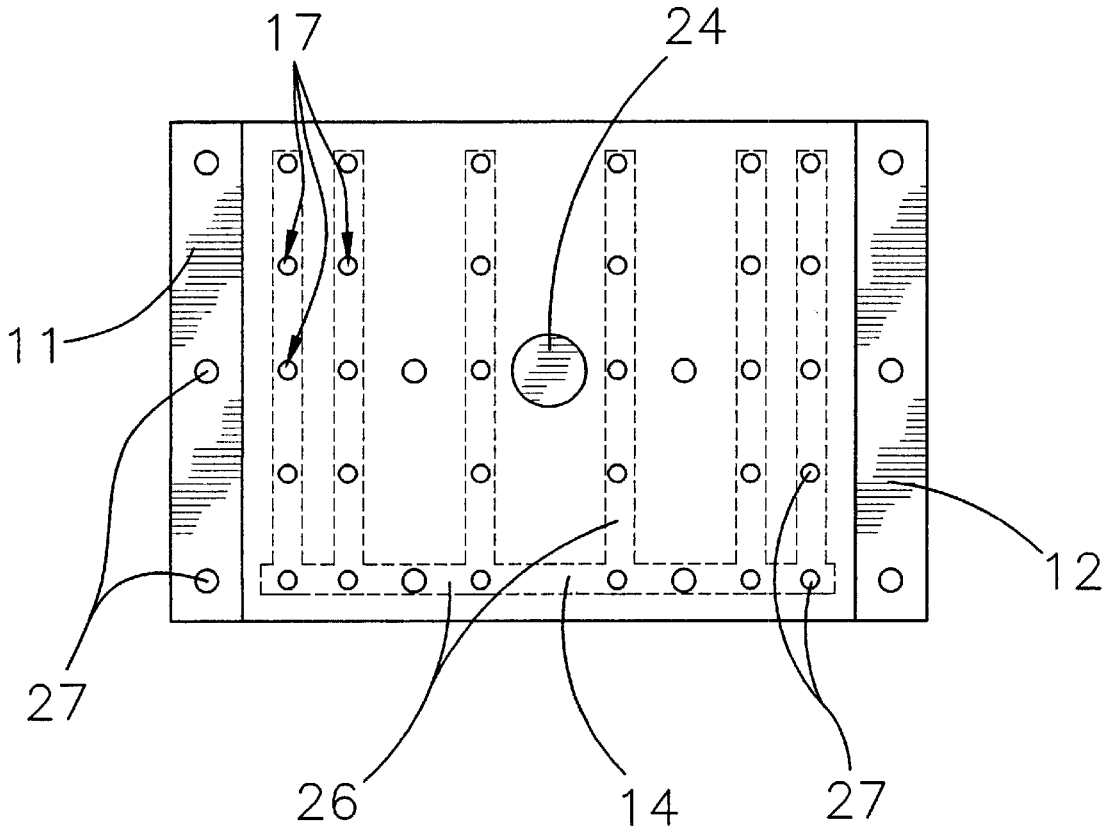
FIG. 2 is a top plan view of the present invention.
Figure 3:
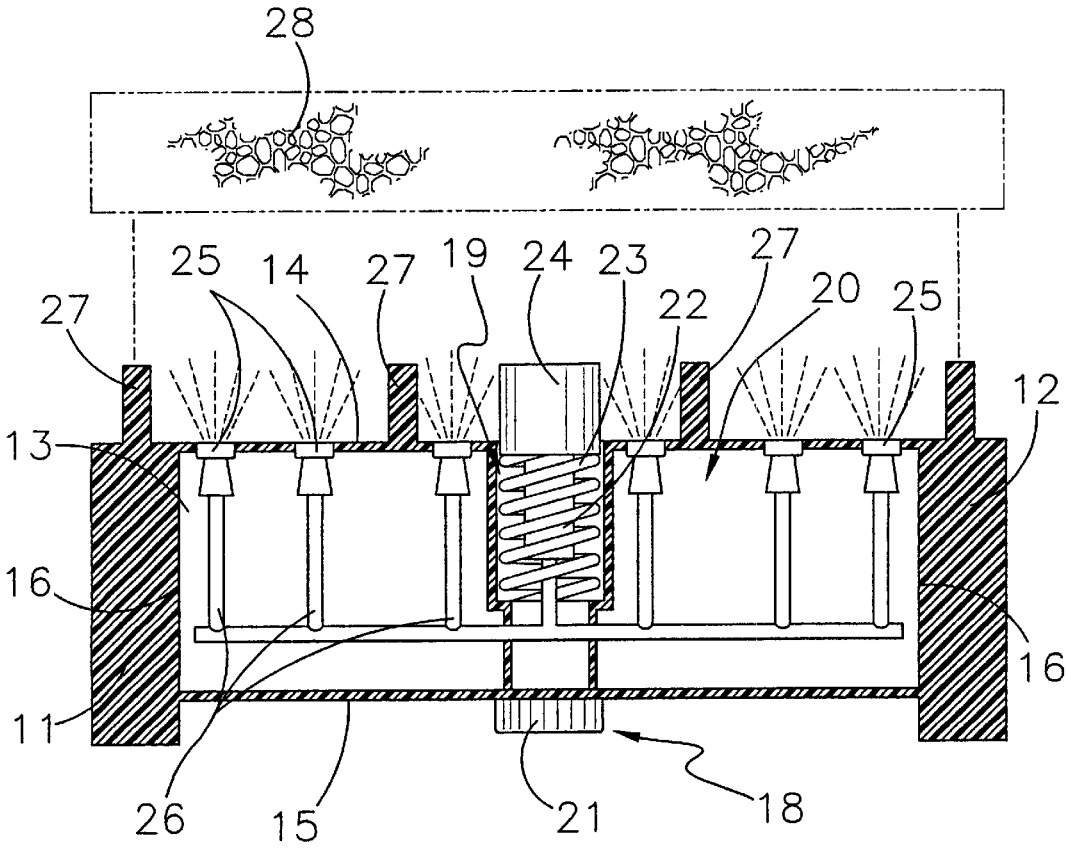
FIG. 3 is a side cross-sectional view of the present invention.

With reference now to the drawings, and in particular to FIGS. 1 through 3 thereof, a new cleaning solution dispensing device embodying the principles and concepts of the present invention and generally designated by the reference numeral 10 will be described.

As best illustrated in FIGS. 1 through 3, the cleaning solution dispensing device 10 generally comprises container support members 11,12 for resting upon a surface, and also comprises a container 13 having top, side, and bottom walls 14–16 and being conventionally attached to the container support members 11,12 and also having a reservoir 20 being disposed therein and further having a plurality of holes 17 being disposed through the top wall 14 and also having an opening 18 being disposed through the bottom wall 15 into the reservoir 20. The container support members 11,12 are legs which are conventionally attached to the side walls 16 of the container 13. The container 13 further includes a slot 19 being disposed in the top wall 14 thereof. A cap member 21 is removably disposed over the opening 18.

A dispensing assembly is conventionally attached to the container 13 for dispensing cleaning solution. The dispensing assembly includes a pump assembly 22,23 being disposed in the slot 19 of the container 13 and being conventionally connected to the reservoir 20, and also includes a plunger 24 being depressibly mounted upon the pump assembly 22,23, and further includes a plurality of nozzles 25 being conventionally disposed in the holes 17 of the container 13, and also includes a plurality of conduits 26 being disposed in the reservoir 20 and being conventionally connected to the nozzles 25. The pump assembly includes a conventional pump member 22 and a spring 23 which is engaged to the plunger 24 and which biases the plunger 24 outwardly of the container 13.

Sponge support members 27 are conventionally disposed upon the container support members 11,12 and the container 13 for supporting a sponge 28. The sponge support members 27 are posts which are spacedly disposed along the side edges of the container 13 and upon the container support members 11,12 and which are adapted to support a sponge 28 thereupon.

In use, the user fills the reservoir 20 with cleaning solution, and depresses the plunger 24 to pump the cleaning solution through the conduits 26 and through the nozzles 25 and onto the sponge 28 which is removably supported upon the posts 27. The user then uses the sponge 28 for cleaning purposes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning solution dispensing device comprising:

container support members for resting upon a surface;

a container having a top, side, and bottom walls and being attached to said container support members and also having a reservoir disposed therein and further having a plurality of holes being disposed through said top wall and also having an opening being disposed through said bottom wall into said reservoir;

a cap member being removably disposed over said opening;

a dispensing assembly being attached to said container for dispensing cleaning solution; and sponge support members being disposed upon said container support members and said container for supporting a sponge.

2. A cleaning solution dispensing device as described in claim 1, wherein said container support members are legs which are attached to said side walls of said container.

3. A cleaning solution dispensing device as described in claim 1, wherein said container further includes a slot being disposed in said top wall thereof.

4. A cleaning solution dispensing device as described in claim 3, wherein said dispensing assembly includes a pump assembly being disposed in said slot of said container and being connected to said reservoir, and also includes a plunger being depressibly mounted upon said pump assembly, and further includes a plurality of nozzles being disposed in said holes of said container, and also includes a plurality of conduits being disposed in said reservoir and being connected to said nozzles.

5. A cleaning solution dispensing device as described in claim 4, wherein said pump assembly includes a pump member and a spring which is engaged to said plunger and which biases said plunger outwardly of said container.

6. A cleaning solution dispensing device as described in claim 1, wherein said sponge support members are posts which are spacedly disposed along said side edges of said container and upon said container support members and are adapted to support a sponge thereupon.

7. A cleaning solution dispensing device comprising:

container support members for resting upon a surface;

a container having a top, side, and bottom walls and being attached to said container support members and also having a reservoir being disposed therein and further having a plurality of holes being disposed through said top wall and also having an opening being disposed through said bottom wall into said reservoir, said container support members being legs which are attached to said side walls of said container, said container further including a slot being disposed in said top wall thereof;

a cap member being removably disposed over said opening;

a dispensing assembly being attached to said container for dispensing cleaning solution, said dispensing assembly including a pump assembly being disposed in said slot of said container and being connected to said reservoir, and also including a plunger being depressibly mounted upon said pump assembly, and further including a plurality of nozzles being disposed in said holes of said container, and also including a plurality of conduits being disposed in said reservoir and being connected to said nozzles, said pump assembly including a pump member and a spring which is engaged to said plunger and which biases said plunger outwardly of said container; and sponge support members being disposed upon said container support members and said container for supporting a sponge, said sponge support members being posts which are spacedly disposed along said side edges of said container and upon said container support members and which are adapted to support a sponge thereupon.

* * * * *